US007244167B2

(12) United States Patent
Falla

(10) Patent No.: US 7,244,167 B2
(45) Date of Patent: Jul. 17, 2007

(54) MOLDED BREAST PAD

(75) Inventor: Gloria Falla, Demarest, NJ (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 33 days.

(21) Appl. No.: 10/624,125

(22) Filed: Jul. 21, 2003

(65) Prior Publication Data

US 2005/0020183 A1 Jan. 27, 2005

(51) Int. Cl.
*A41C 3/10* (2006.01)
*A41C 3/14* (2006.01)

(52) U.S. Cl. ..... 450/54; 450/39; 2/267

(58) Field of Classification Search ..... 450/54–57, 450/39, 41, 1, 90, 92, 93; 2/267, 268, 243.1, 2/69, 73, 78.1–78.4; 264/257, 258, 291, 264/292, 294, 320, 321, 145, 152–155, 157–160, 264/163; 156/245
See application file for complete search history.

(56) References Cited

U.S. PATENT DOCUMENTS

| | | | | |
|---|---|---|---|---|
| 2,333,434 | A | 8/1943 | Middlecoff | |
| 2,834,352 | A * | 5/1958 | Ullian | 450/57 |
| 3,934,593 | A * | 1/1976 | Mellinger | 450/56 |
| 5,492,501 | A | 2/1996 | Brown | |
| 6,439,959 | B1 | 8/2002 | Magrone et al. | |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

A three-dimensional molded breast pad for a brassiere is provided. The molded breast pad has a cup shape with at least one or more first layers of a first material and one or more second layers of a second material. The first and second layers/materials have different loft characteristics associated therewith. These loft characteristics influence, at least in part, the elastomeric properties of the first and second layers/materials. Thus, the molded breast pad is a moldable three-dimensional breast pad cooperative with a brassiere to support, shape and/or smooth the contours of a wearer's breast.

23 Claims, 4 Drawing Sheets

MOLDED BREAST PAD

BACKGROUND OF THE INVENTION

1. Field of the Invention

The present invention relates to brassieres. More particularly, the present invention relates to a molded breast support cup or pad for spot support and shaping.

2. Description of the Prior Art

Brassieres are well known. Notwithstanding this fact, manufacturers of brassieres are continuously attempting to develop brassieres that improve on that which is conventionally known. This, as well as the demand and/or desire for brassieres that provide an optimal balance of comfort, support, and feminine allure, evidences the desirability and/or need for simple, effective and appropriate brassiere fashioning solutions. Hence, there is a need for a molded breast pad operatively connectable with a brassiere to enhance the comfort, support, and/or feminine allure associated therewith.

SUMMARY OF THE INVENTION

It is an object of the present invention to provide a molded breast pad that is suitable to meet the above noted need for enhancing the comfort, support, and feminine allure of a brassiere.

It is another object of the present invention to provide a molded breast pad that is fashioned from at least two materials having distinct loft characteristics.

It is still another object of the present invention to provide a molded breast pad that is partitioned into at least a supporting part and at least a shaping part, each part having attributes for facilitating spot control, uplift and/or shaping as desirable.

It is a further object of the present invention to provide method and apparatus for forming a molded breast pad suitable to enhance the comfort, support, and feminine allure associated with a brassiere.

These and other objects and advantages of the present invention are achieved by a molded breast pad cooperative with a brassiere to support, shape and/or smooth the contours of a breast. The molded breast pad preferably has a three-dimensional cup shape with at least two portions, a first upper part and a second lower part. The molded breast pad is preferably formed from a material block with one or more first layers of a first material and one or more second layers of a second material. The first layers/material preferably has first loft characteristics and the second layers/material preferably has second loft characteristics, differing from those of the first layers/material. Preferably, the first and second layers/materials have elastomeric properties associated therewith that are, at least in part, dependent on the loft characteristics thereof.

BRIEF DESCRIPTION OF THE DRAWINGS

Other and further objects, advantages and features of the present invention will be understood by reference to the following specification in conjunction with the accompanying drawings, in which like reference characters denote like elements of structure.

DETAILED DESCRIPTION OF THE INVENTION

Figure 1:
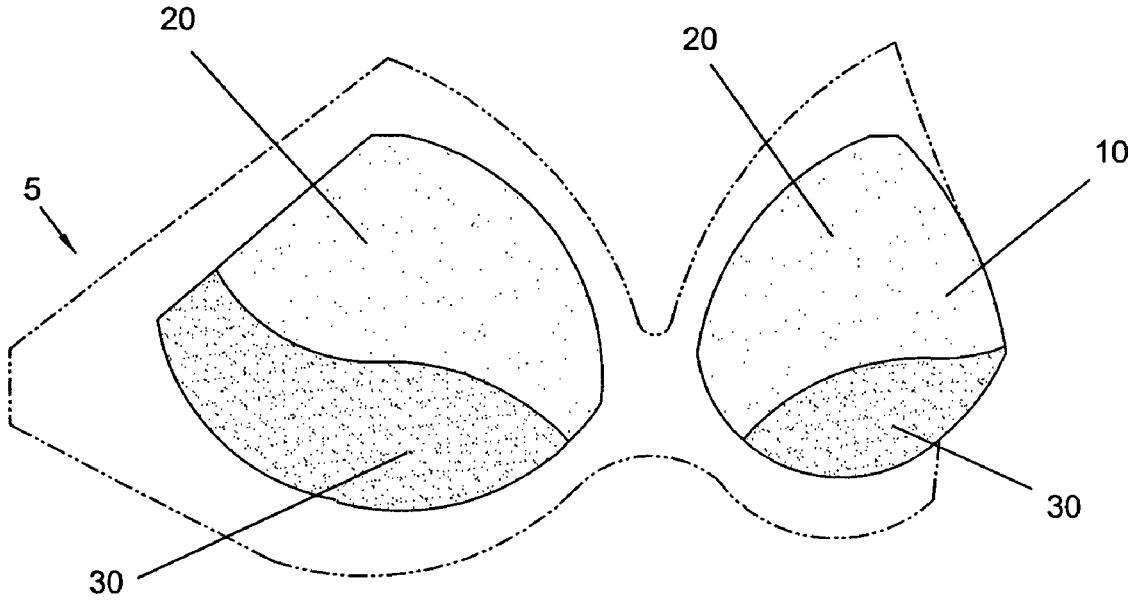
FIG. 1 is a front perspective view of a brassiere having two cup portions cooperative with a molded breast pad in accordance with an illustrative embodiment of the present invention.

Referring to the drawings and, in particular to FIG. 1, there is shown an illustrative embodiment of a molded breast pad cooperatively connected with a breast cup of a brassiere 5. Brassiere 5 has side panels 7 proximate each molded breast pad 10. The molded breast pad is generally represented by reference numeral 10. The term cooperative is intended to imply that molded breast pad 10 can be separably connected with brassiere 5, integrally formed with brassiere 5, or otherwise associated with brassiere 5 to provide the intended effects discussed herein. The molded breast pad 10 preferably has at least two parts, a first part 20 and a second part 30. The respective first and second parts 20, 30 preferably have different and/or distinct properties/characteristics.

Figure 2:
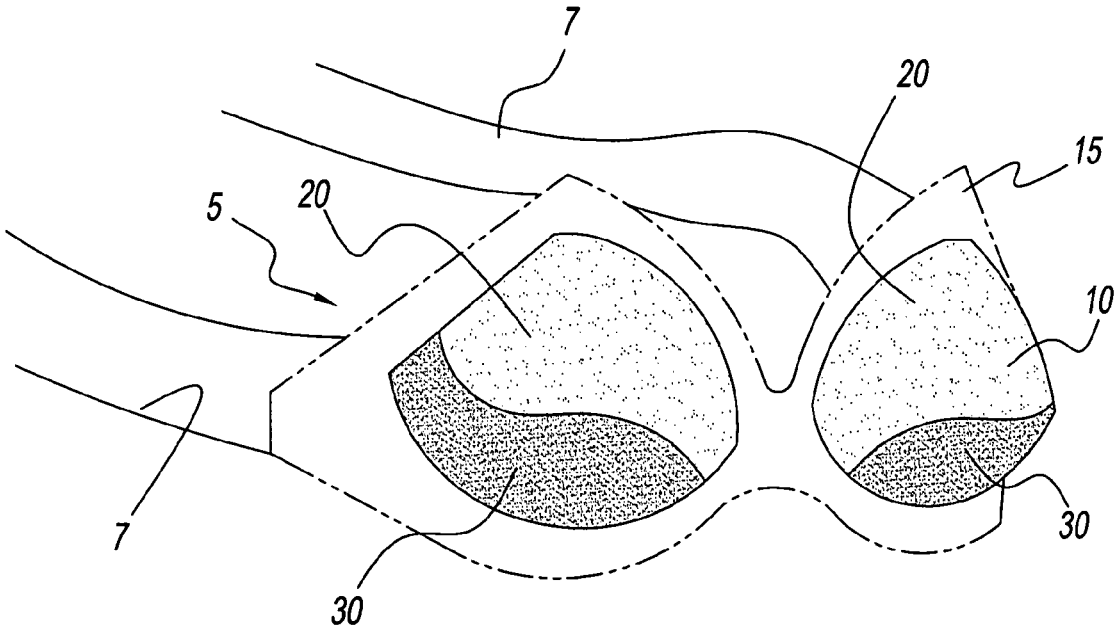
FIG. 2 is an exploded side perspective view of a material block in accordance with an illustrative embodiment of the present invention.

Referring to FIG. 2, the molded breast pad 10 is preferably fashioned from an assembly of material or a material composite or block 40. The material block 40 preferably has one or more layers fashioned from a first material 42 and one or more layers fashioned from a second material 44. For example, as reflected in FIG. 2, material block 40 can have one or more intermediate layers 46 of first material 42 and one or more outer layers 48 of second material 44. It is noted that outer layers 48 although preferably formed from second material 44, need not be identical in construction or form. It is further noted that any of a variety of layer arrangements/combinations to form the block may also be used.

First material 42 preferably has an inherent loft 41 associated therewith. Further, first material 42 preferably is innately flexible with one or more elastomeric properties associated therewith. Thus, intermediate layer 46 can be a lofted material (e.g., foam) suitable for spot shaping and/or smoothing the contours of a breast. Preferably, the innate elastomeric characteristics of first material 42 are dependent on the loft associated therewith. Hence, the flexibility of intermediate layer 46 can preferably be influenced or changed by manipulating the loft of the first material.

Accordingly, first material 42 and/or intermediate layer 46 are preferably moldable and suitable to provide any of a variety of stylistic effects. The loft and/or flexible properties of first material 42 and/or intermediate layer 46 preferably facilitate providing superior control, support and/or uplift as desired to enhance the feminine allure of a breast and/or reduce the negative effects caused by gravity. Preferably, intermediate layer 46 can be fashioned using any known technique suitable or conventionally known for accomplishing such a task (e.g., via sewing, knitting, weaving, injection molding, etc.).

First material 42 can be manmade or naturally occurring, aesthetically pleasing or decorative, comfortable or soft to the touch, and/or durable or resilient in nature (e.g., foam rubber). Intermediate layer 46, if desirable, can be positioned and/or secured, with respect to the one or more outer layers 48, only where essential to provide a desired effect (e.g., shape, comfort, uplift, aesthetic allure, etc.).

Preferably, second material 44 of one or more outer layers 48 preferably has an inherent loft 43 associated therewith. Further, second material 44 preferably is innately flexible with one or more elastomeric properties associated therewith. Still further, the inherent loft and/or flexible properties associated with second material 44 preferably differ from those associated with first material 42. For example, if the loft associated with one or more intermediate layers 46 is about ⅛ of inch, then preferably, the loft associated with one or more outer layers 48 is less than about ⅛ of an inch, or, if intermediate layer 46 is relatively more flexible, then preferably, one or more outer layers 48 are relatively less flexible.

Second material 44 and/or outer layers 48, like first material 42 and/or intermediate layer 46, are preferably moldable and suitable to provide a variety of stylistic effects. The loft and/or flexible properties of second material 44 and/or outer layers 48 preferably facilitate providing superior control, support and/or uplift as desired to enhance the feminine allure of a breast and/or reduce the negative effects caused by gravity. Preferably, outer layers 48 can be fashioned using any known technique suitable or conventionally known for accomplishing such a task (e.g., via sewing, knitting, weaving, injection molding, etc.). Preferably, the second material 44 can be manmade or naturally occurring, aesthetically pleasing or decorative, comfortable or soft to the touch, and/or durable or resilient in nature (e.g., cotton, polyester, rayon, spandex, etc.).

If there are two or more outer layers 48, each layer need not have the same construction or form. Hence, each outer layer 48 can be discretely shaped, sized and/or configured to provide any of a variety of effects. For example, outer layers 48 can provide an aesthetic impression that preferably enhances the feminine allure of a brassiere, or improve the degree of comfort and/or reduce the irritation associated with wearing such a brassiere. Outer layers 48, if desirable, can be positioned and/or secured, with respect to intermediate layer 46, only where essential to provide a desired effect (e.g., comfort, support, aesthetic allure, etc.).

It is noted that additional layers may be incorporated as part of material block 40. For example, a separate adhesive or bonding layer 50 can be used to fuse or bond the various layers of the assembly together. This bonding layer can have elastic properties sufficient to compliment those associated with the materials used to form the various layers of the material block 40. Bonding layer 50 is preferably suitable for cooperating with a variety of textile and/or material forming techniques, including microfibers and/or specialized nonwovens. Also, bonding layer 50 can be integral with either and/or both first and second materials 42, 44.

Referring to FIGS. 3 through 6, molded breast pad 10 is preferably formed using a molding apparatus 60 having at least two elements, a first element 61 and a second element 62. First element 61 and second element 62 preferably cooperatively interact with one another.

Preferably, first element 61 is a surface heated plate with one or more surface structures 63 thereon. First element 61 can be heated via any suitable method sufficient to accomplish the intended purposes thereof. For example, first element 61 can be heated via electric heating wires or rods, which transmit heat to a contacting surface 64 of the first element. First element 61 can facilitate the controlled placement and/or lamination or bonding layer 50. First element 61 can be movable relative to second element 62. Alternatively, first element 61 can be rigid and relatively stationary with respect to second element 62. Further, the contacting surface 64 of first element 61 can have any of a variety of textures, patterns and/or configurations sufficient to provide any of a variety of different effects on the breast pad. Preferably, however, contacting surface 64 has at least two distinct areas 65, 66, shown clearly in FIG. 4, corresponding to and/or creating first and second parts 20, 30, respectively, shown in FIG. 1, of molded breast pad 10. Preferably, areas 65, 66 interact with molded breast pad 10 to provide a different effect to each first and second parts 20, 30. For example, areas 65, 66 can be such that first part 20 is caused to be substantially compressed relative to second part 30, or vice-versa. Preferably, a demarcation line 45 that separates the compressed portion from the rest of the pad is created.

Demarcation line 45 preferably runs through or along a center portion of the pad. However, other configurations are also possible. Preferably, demarcation line 45 is outwardly discrete or unnoticeable in application. That is, demarcation line 45 is preferably formed on an inward or body contacting surface 47 of molded breast pad 10 such that an opposing or an outward surface 49 of molded breast pad 10 can be substantially uniformly smooth.

Second element 62 is preferably a surface heated support plate with one or more surface structures 63 thereon. As discussed above, second element 62 cooperates with first element 61 to form molded breast pad 10 from material block 40. Second element 62 is preferably heated via any suitable method sufficient to accomplish the intended purposes thereof. For example, second element 62 can be heated via electric heating wires or rods, which transmit heat to a contacting surface 67 thereof. Second element 62 can be movable relative to first element 61. Second element 62 can alternatively be rigid and relatively stationary with respect to first element 61. The contacting surface 67 of second element 62 can have any of a variety of textures, patterns and/or configurations sufficient to provide any of a variety of different effects to breast pad 10. For example, contacting surface 67 of second element 62 can have a plurality of nodes, dimples or grooves 70 for cooperating with a plurality or a number of complementary nodes, dimples or grooves provided on first element 61. However, more preferably, the contacting surface 67 of the second element 62 has at least two distinct areas 68, 69 corresponding and/or cooperative with the at least two areas 65, 66 of first element 61, as well as with first and second parts 20, 30 of molded breast pad 10.

Figure 3:
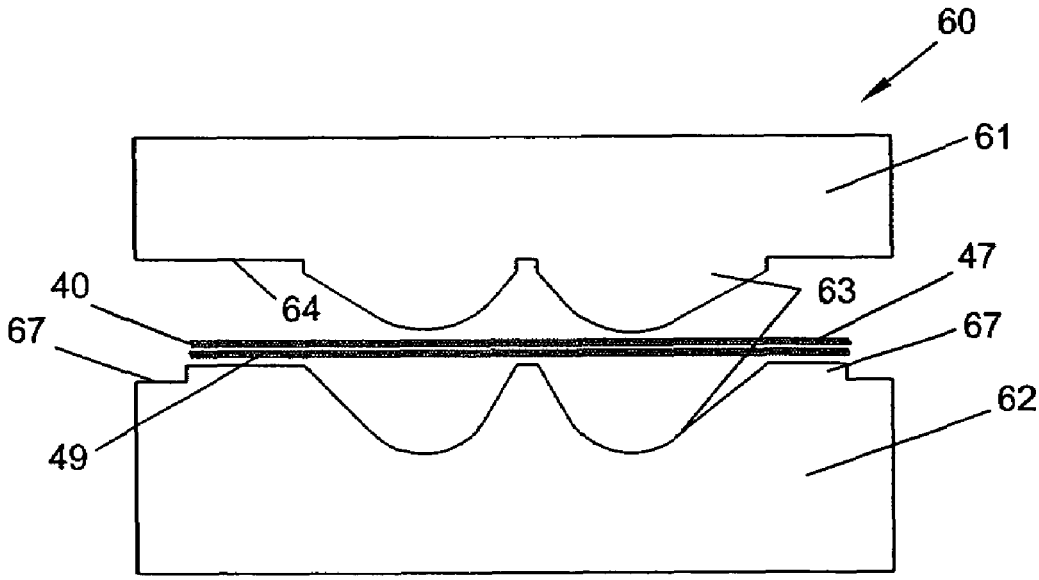
FIG. 3 is a side sectional view of a molding apparatus and the material block of FIG. 2 in accordance with an illustrative embodiment of the present invention, showing the apparatus in an open state.
Figure 4:
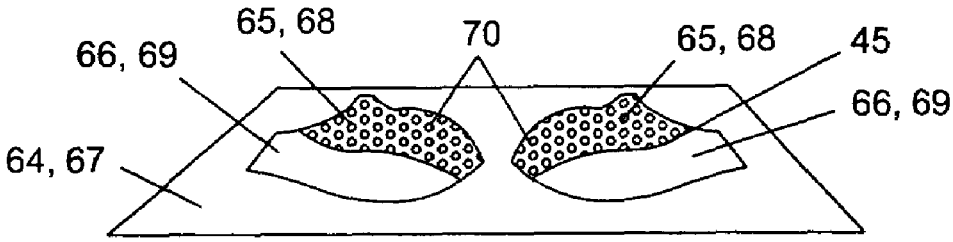
FIG. 4 is a plan perspective view of a contacting surface of the apparatus of FIG. 3 in accordance with an illustrative embodiment of the present invention.
Figure 5:
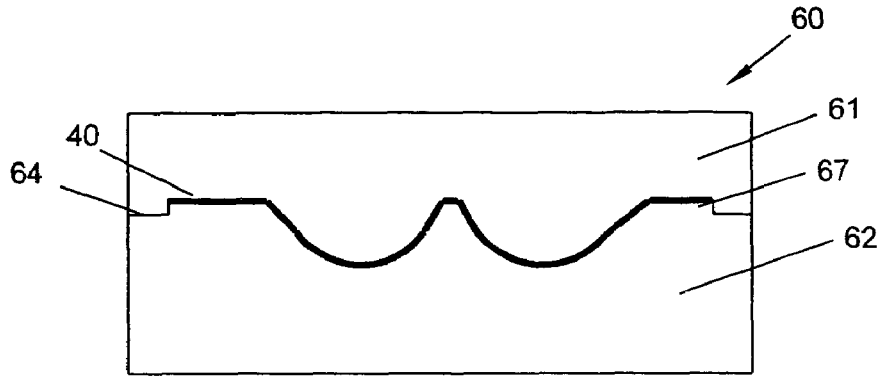
FIG. 5 is a side sectional view of the apparatus of FIG. 3 and the material block of FIG. 2, showing the apparatus in a closed state.
Figure 6:
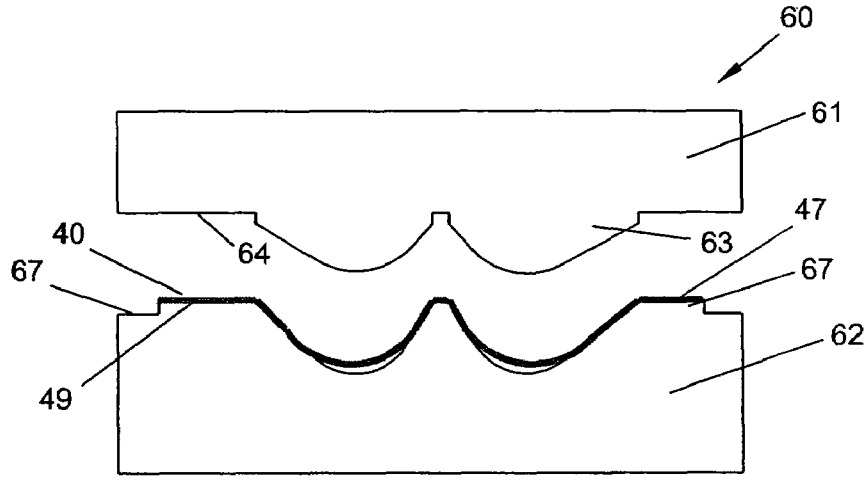
FIG. 6 is a side sectional view of the apparatus of FIG. 3 and the material block of FIG. 2, showing an integral molded material block in accordance with an illustrative embodiment of the present invention.
Figure 7:
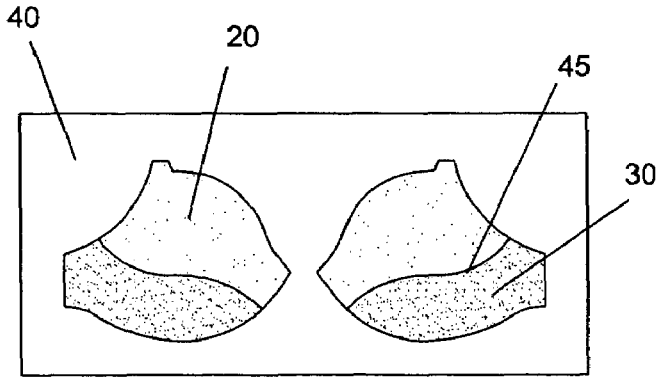
FIG. 7 is a plan view of the integral molded material block of FIG. 5.
Figure 8:
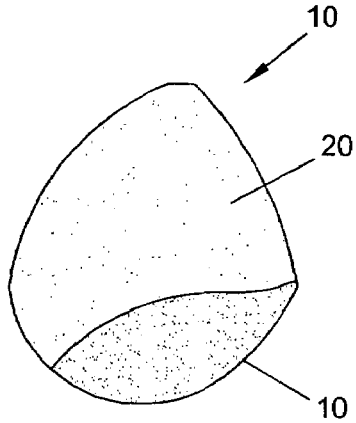
FIG. 8 is a perspective view of the molded breast pad of FIG. 1.

Having described some of the preferred characteristics of the illustrative embodiment, the process or method for forming molded breast pad 10, preferably includes at least the following steps. Referring to FIG. 3, material block 40 is first positioned in a molding apparatus having at least one first element 61, and at least one second element 62. Then, as shown in FIG. 5, first element 61 is moved into a closed relation with second element 62, or vice-versa, sandwiching the material block 40 therebetween. Now, referring to FIG. 6, first element 61 is opened in relation to second element 62, or vice-versa, leaving one or more three dimensional molded breast pads in material block 40, like that shown in FIG. 7. Thereafter, as shown in FIG. 8, any excess material can be eliminated as appropriate for the one or more molded breast pads to cooperate with a brassiere to support, shape and smooth the contours of a breast.

It is noted that various other steps and/or features well known in the art may also be incorporated into the present invention as appropriate for forming a desired breast pad. Thus, for example, various alternative techniques for connecting fabrics/materials can used, various different cutting and/or finishing techniques can be used, or various material types may also be used as appropriate.

The present invention having been thus described with particular reference to the preferred forms thereof, it will be obvious that various changes and modifications may be made therein without departing from the spirit and scope of the present invention as defined herein.

What is claimed is:

1. A molded breast pad for a brassiere having a body-contacting surface, comprising:

one or more first layers being formed from a first material, said first material having a first loft associated therewith; and one or more second layers being formed from a second material, said second material having a second loft associated therewith different from that of said first material, wherein the molded breast pad is molded such that a first portion thereof is compressed relative to a second portion thereby forming a demarcation line between said first portion and said second portion that is formed on the body-contacting surface and that is not visible on a wearer's breast during wear, said first portion being an upper portion, said second portion being a lower portion, said demarcation line running through a center portion of the pad to separate said upper portion and said lower portion.

2. The molded breast pad of claim 1, wherein said one or more first layers are situated intermediate at least two of said one or more second layers.

3. The molded breast pad of claim 1, wherein said first material has elastomeric properties associated therewith.

4. The molded breast pad of claim 3, wherein said second material has elastomeric properties associated therewith that differ from those of said first material.

5. The molded breast pad of claim 1, wherein said first material has elastomeric properties that depend on said first loft such that the flexibility of said one or more first layers can be changed by manipulating the extent of said first loft.

6. The molded breast pad of claim 1, wherein said compressed portion of the molded breast pad has different elastomeric properties than a remaining portion of the molded breast pad.

7. The molded breast pad of claim 1, wherein said demarcation line is formed on a body contacting surface of the pad such that an opposing surface of the molded breast pad is substantially smooth.

8. A brassiere having the molded breast pad of claim 1.

9. A molded breast pad having a body-contacting surface, comprising:

a first part having a relatively full loft;

a second part having a loft relatively reduced from said loft of said first part; and a demarcation line separating said first part from said second part, said line of demarcation formed on the body-contacting surface and not being visible on a wearer's breast during wear, said first portion being an upper portion, said second portion being a lower portion, said demarcation line running along a center portion of the pad to separate said upper portion from said lower portion, wherein said first part and said second part are both formed from a material block having one or more first layers of a first material and one or more second layers of a second material.

10. The molded breast pad of claim 9, wherein said one or more first layers are situated intermediate at least two of said one or more second layers.

11. The molded breast pad of claim 9, wherein said first material has elastomeric properties associated therewith.

12. The molded breast pad of claim 11, wherein said second material has elastomeric properties associated therewith that differ from said elastomeric properties of said first material.

13. The molded breast pad of claim 9, wherein said first material has elastomeric properties that depend on the loft thereof such that the flexibility of said one or more first layers can be changed by manipulating or changing said loft.

14. The molded breast pad of claim 9, wherein said second part has elastomeric properties that differ from said elastomeric properties of said first part.

15. The molded breast pad of claim 9, wherein said demarcation line is formed on a body contacting surface of the pad such that an opposing surface of the molded breast pad is substantially smooth.

16. A brassiere having the molded breast pad of claim 9.

17. A method of forming a molded breast pad, comprising the steps of:

providing a material block having one or more first layers of a first material and one or more second layers of a second material, said first material and said second material each having different lofts associated therewith;

positioning said material block in a molding apparatus such that said molding apparatus can interact with the material block;

causing said molding apparatus to interact with said material block to form one or more three-dimensional breast pads having three-dimensional cup shapes with a portion thereof being effected such that said portion has a relatively reduced loft, wherein said reduced loft portion forms a demarcation line with the rest of said three dimensional breast pad that is not visible on wearer's breast during wear, said demarcation line running along a center portion of the pad to separate an upper portion and a lower portion of said pad.

18. The method of claim 17, wherein said demarcation line separates said reduced loft portion from the rest of said three dimensional breast pad.

19. A molded breast pad for a brassiere having a body-contacting surface, comprising:

one or more first layers being formed from a first material, said first material having a first loft associated therewith; and one or more second layers being formed from a second material, said second material having a second loft associated therewith different from that of said first material, wherein the molded breast pad is molded such that a first portion thereof is compressed relative to a second portion thereby forming a demarcation line between said first portion and said second portion, said first portion being an upper portion, said second portion being a lower portion, said demarcation line running along a center portion of the pad to separate said upper portion and said lower portion.

20. A molded breast pad for a brassiere having a body-contacting surface, comprising:

one or more first layers being formed from a first material, said first material having a first loft associated therewith; and one or more second layers being formed from a second material, said second material having a second loft associated therewith different from that of said first material, wherein the molded breast pad is molded such that a first portion thereof is compressed relative to a second portion thereby forming a demarcation line between said first portion and said second portion that is formed on the body-contacting surface and that is not visible on a wearer's breast during wear said first portion being an upper portion, said second portion being a lower portion, said demarcation line running along a center portion of the pad to separate said first portion and said second portion.

21. A molded breast pad for a brassiere having a body-contacting surface, comprising:

one or more first layers being formed from a first material, said first material having a first loft associated therewith; and one or more second layers being formed from a second material, said second material having a second loft associated therewith different from that of said first material, wherein the molded breast pad is molded such that a first portion thereof is compressed relative to a second portion thereby forming a three-dimensional cup shape, one of said first portion or said second portion being a first upper portion and the other of said first portion or said second portion being a lower portion of the pad, wherein a by said upper portion is separated from said lower portion.

22. A molded breast pad for a brassiere having a body-contacting surface, comprising:

one or more first layers being formed from a first material, said first material having a first loft associated therewith; and one or more second layers being formed from a second material, said second material having a second loft associated therewith different from that of said first material, wherein the molded breast pad is molded such that a first part thereof is compressed relative to a second part thereby forming a demarcation line between said first part and said second part, said demarcation line running along a center portion of the pad, said first part being an first upper part and said second part being a second lower part, said demarcation line separating said upper part from said lower part.

23. A molded breast pad for a brassiere, said brassiere having a pair of breast-receiving cups and two side panels, one of said side panels associated with one of said pair of breast-receiving cups and the other of said two side panels associated with the other of said pair of breast-receiving cups, said pad comprising:

one or more first layers being formed from a first material, said first material having a first loft associated therewith; and one or more second layers being formed from a second material, said second material having a second loft associated therewith different from that of said first material, wherein the molded breast pad is molded such that a first portion thereof is compressed relative to a second portion thereby forming a demarcation line between said first portion and said second portion that is formed on the body-contacting surface and that is not visible on a wearer's breast during wear, said first portion being an upper portion and said second portion being a lower portion, said demarcation line having two ends, one of said two ends proximate a center portion of the brassiere between said two breast-receiving cups and the other of said two ends proximate a side panel of the breast-receiving cup, said demarcation line traversing a central portion of said pad, separating said upper portion from said lower portion.

* * * * *